United States Patent [19]

Garney et al.

[11] 4,254,830

[45] Mar. 10, 1981

[54] GEOTHERMAL WELL SAMPLER APPARATUS

[75] Inventors: Tom A. Garney; Raymond E. Roesner, both of Houston, Tex.

[73] Assignee: Dresser Industries, Inc., Dallas, Tex.

[21] Appl. No.: 74,351

[22] Filed: Sep. 10, 1979

[51] Int. Cl.[3] ..... E21B 49/08

[52] U.S. Cl. ..... 166/162; 166/169; 166/264

[58] Field of Search ..... 166/162–169, 166/264; 73/155

[56] References Cited

U.S. PATENT DOCUMENTS

| | | | |
|---|---|---|---|
| 1,775,641 | 9/1930 | Haertl | 166/165 |
| 2,147,983 | 2/1939 | Lindsly | 166/165 X |
| 2,316,216 | 4/1943 | Bandy | 166/164 |
| 2,332,813 | 10/1943 | Rolshausen et al. | 166/164 X |
| 2,686,566 | 8/1954 | Barnes | 166/166 X |
| 2,938,388 | 5/1960 | Byrnes | 166/162 X |
| 3,981,189 | 9/1976 | Howard et al. | 166/264 X |

OTHER PUBLICATIONS

Klyen, L. E., "A Vessel for Collecting Subsurface Water Samples for Geothermal Drillholes", *Geothermetrics,* vol. 2, No. 2, 1973.

*Primary Examiner*—Stephen J. Novosad
*Attorney, Agent, or Firm*—Richard M. Byron; Pat McCollum

[57] ABSTRACT

An elongated body member, a portion of which forms a chamber for retaining samples of the liquid and steam contents of a geothermal well. A fluid tight seal is formed between an O-ring and a parallel sealing face of a slidable shaft member. The pressure sealing force is adjustably controlled by a spring assembly. The spring assembly is adjusted so that the sealing force must be overcome before a sample is taken. When the sealing force exerted upon the seal is overcome, the sample chamber is placed in fluid communication with the geothermal borehole by a series of passages which include grooves or slots contained in the slidable shaft member. After sampling is complete the seal is reformed allowing the sampler to be retrieved to a surface location.

6 Claims, 2 Drawing Figures

GEOTHERMAL WELL SAMPLER APPARATUS

BACKGROUND OF THE INVENTION

This invention relates generally to apparatus for evaluation of geothermal wells and more specifically to apparatus for collecting subsurface liquid or steam samples from geothermal drillholes.

In one type of geothermal energy development project, a borehole is drilled into a region of low-permeability, hot crystalline rock and a large hydraulically fractured area is produced from the bottom of the borehole. A second borehole is directionally drilled to intersect the fractured region. Pressurized water is pumped down one borehole, circulated through the fractured area of the formation to recover heat from the rock, and returned by way of the second borehole to the surface where energy is extracted.

In the development of geothermal energy it is highly desirable to evaluate borehole and formation characteristics. One such desirable measurement is to sample the liquid or steam present within the geothermal borehole. Chemical analysis of discrete borehole samples have proven useful in the determination of reservoir properties. Such samples enable accurate assessment to be made of the water or steam composition or steam quality providing associated correlations with rock mineralogy, temperature and pressure.

Apparatus for retrieving samples of borehole fluid have been well known in the oil and gas industry for many years. Devices of this class have been tried and have been proven unsuitable for sampling in geothermal boreholes. Standard oil and gas borehole samplers have been unable to endure in geothermal environments, due to limitations with respect to time-temperature exposure capacity. A sampler for use in a geothermal environment must be capable of sustained operation at temperatures above 200° centigrade. This temperature range requirement is considerably above the upper operating temperature limit of standard oil and gas borehole fluid samplers. Samplers designed specifically for use in the geothermal environment have fallen into two broad classes: (1) bottles initially open which close after sampling and (2) bottles which remain closed throughout descent and ascent and open only for sample collection. A typical sampler of class one would utilize ball valve seals at the upper and lower sample chamber openings. As the apparatus descends the borehole, both valves are held unsealed by flow drag created by descent. Upon retrieval the upper ball valve seals under the weight of the ball plus pressure created by the retrieval velocity of the sampler. In ascent, the lower valve seal is sealed under the weight of the ball alone. Samplers of this general type, while mechanically simple and able to operate in high temperatures, have proven unsatisfactory. With this design, there in uncertainty as to the time of ball valve sealing and uncertainty as to whether the seal remained intact during retrieval from the borehole. A further shortcoming is the difficulty of adequate flushing of the sample chamber prior to sampling, due to the relatively small valve apertures through which purging of the sample chamber must occur during descent.

A particular prior art sampler of the second class utilizes an electronic of mechanical clock, a trigger unit and linkage connecting the trigger unit to a valve. In operation, when the clock fires the trigger unit opens the valve sealing the sample chamber allowing a sample of borehole fluid to be taken. When the pressure within the chamber equalizes with the borehole pressure the valve shuts, sealing the sample within the chamber. While representing a considerable improvement over samplers of the class one type, samplers using clockwork mechanisms have not proven reliable in high temperature operations and have an excessive servicing requirement.

Another sampler of the class two design utilizes an inertia mechanism combined with a break-off tube to eliminate clock mechanisms. Upon arrival at the sampling location within the borehole the wireline suspending the sampler in the borehole is vigorously shaken. The oscillation of the inertia mechanism causes a striker to shatter a break-off tube allowing a fluid sample to enter the sample chamber through non-return valve. As the sample chamber fills and the pressure within the sample chamber equalizes with the borehole pressure the valve closes. As is apparent from the above description, an operator at a surface location can never be confident that he has oscillated the instrument enough to assure the break-off tube has been shattered. Thus, while this sampler meets environmental requirments, it is less than completely reliable in retrieving a sample of the liquid or steam within the borehole.

Accordingly, the present invention overcomes the deficiencies of the prior art by providing a simple mechanical apparatus for the reliable collection of liquid or steam samples from the hostile environment of a geothermal borehole.

SUMMARY OF THE INVENTION

A sampling device for use in a geothermal borehole having an elongated body member, a portion of the body member forming a sample chamber for retaining samples of the liquid or steam present in a geothermal well. The sample chamber is isolated from the borehole by a fluid tight seal formed O-ring seat between two parallel surfaces, one surface being fixed and the other surface being a part of a slidable shaft member. The integrity of the seal is controlled by force exerted upon the slidable shaft member by a spring. The exerted spring force is adjustable by means of a threadable spring force adjuster and can be set to control the depth within the borehole at which the sample is taken.

When the sampler comes proximate the predetermined borehole location the sealing force exerted on the O-ring seal is overcome and the shaft member slides upward breaking the fluid seal placing the sample chamber in fluid communication with the borehole. Fluid communication is established by means of a series of passages and slots contained in the slidable shaft member. When the sample taking process is complete the fluid tight O-ring seal is reformed and the instrument withdrawn from the borehole to a surface location. At the surface the sample obtained can be removed from the sample chamber for chemical analysis to determine borehole conditions.

Accordingly, it is a feature of the present invention to provide new and improved liquid or steam sample taking apparatus for use in geothermal boreholes.

It is still another feature of the invention to provide a new and improved geothermal sample taking apparatus which is purely mechanical in character and capable of prolonged operation in high temperature environments.

It is still another feature of the invention to provide an apparatus for taking a sample of the contents of a geothermal borehole at any predetermined depth within the borehole.

DETAILED DESCRIPTION OF THE PREFERRED EMBODIMENT

Figure 1:
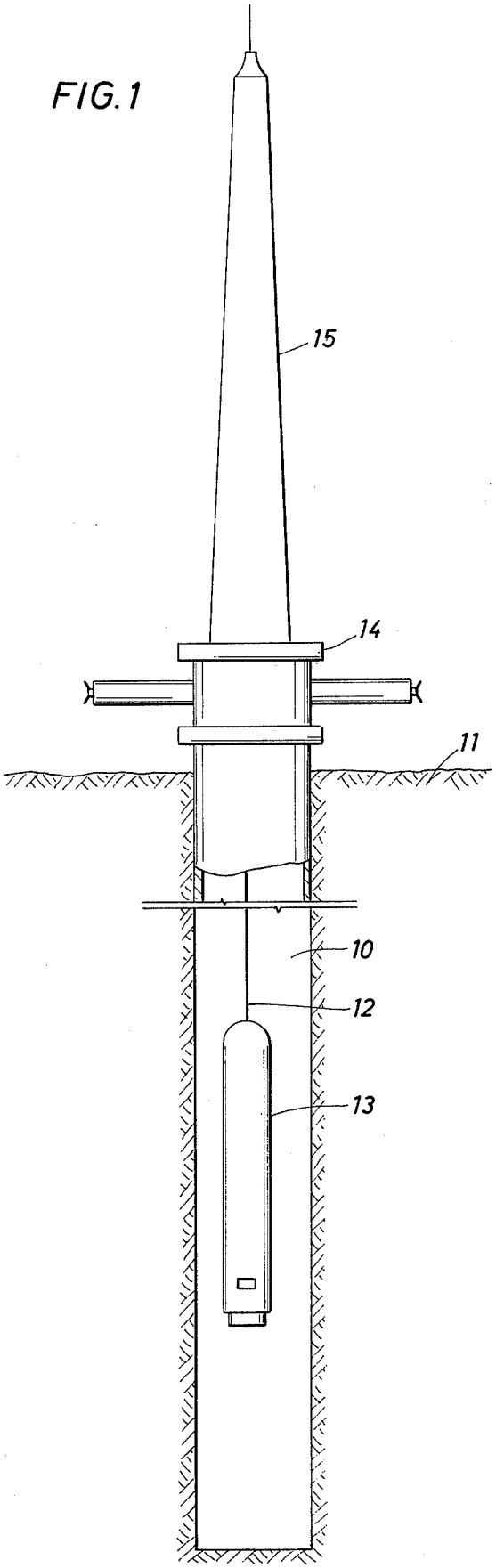
FIG. 1 is a side elevational view, partly in cross section, of a well logging instrument within a geothermal well in accordance with the invention.

Referring now to the drawings in more detail, especially to FIG. 1, there is illustrated schematically a geothermal borehole 10 penetrating a portion of the earth 11, shown in vertical section. Disposed within borehole 10 by means of cable or wireline 12 is borehole fluid sampler 13. Located atop the geothermal well is blowout preventer 14 and lubricator 15 through which cable 12 passes, allowing sampler 13 to be caused to traverse the borehole 10.

The geothermal borehole, as illustrated by FIG. 1, may be of a class filled with steam only, or filled with liquid only or may be filled with some combination of steam and liquid. The typical operating temperature in such a geothermal borehole will be in a range above 150° centigrade and there may be several thousands pounds of pressure within the borehole. In such a hostile environment it is necessary that the operating elements of the well, such as blowout preventer 14, lubricator 15 and cable 12 of a suitable design which will withstand prolonged high temperature operation.

Figure 2:
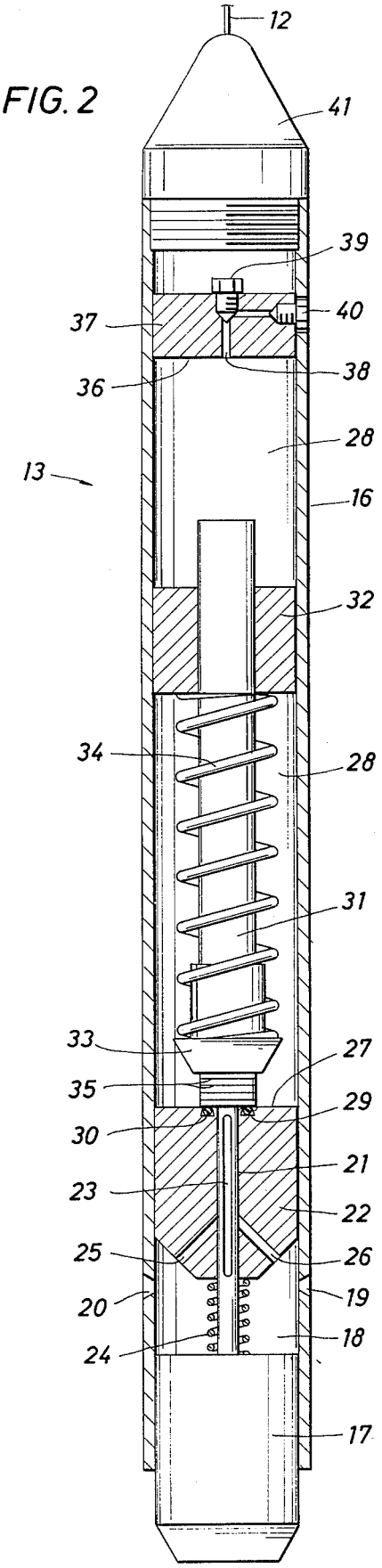
FIG. 2 is a schematic view, partly in cross section, of the geothermal well fluid sampler apparatus.

Referring now to FIG. 2, there is a longitudinal sectional view illustrating the details of the geothermal borehole sampler 13 of the present invention. Sampler 13 is constructed of an elongated, metallic housing 16 designed to allow easy passage through the borehole while being capable of withstanding the thermal and physical abuses encountered therein. Protruding from the distal end of housing 16 is a portion of landing pad 17 which is slidably mounted within housing 16. A portion of landing pad 17 within housing 16 is of a reduced diameter creating annulus 18. Housing 16 has interconnecting passages 19 and 20 providing fluid communication between the borehole and annulus 18. Threadably connected to the reduced diameter portion of pad 17 is elongated shaft member 21 which passes through and is slidable within block 22, block 22 being firmly affixed to housing 16. Shaft member 21 contains a plurality of elongated slots or grooves, illustrated by slot 23. Located about the reduced diameter portion of pad 17 and abutting the surfaces of pad 17 and block 22 is spring 24. Block 22 is equipped with passages 25 and 26 which provide fluid communication between annulus 18 and the slots 23 of shaft member 21.

The upper surface 27 of block 22 forms the lower wall of sample collection chamber 28. This upper surface 27 contains a dove-tailed O-ring groove 29 with a high temperature O-ring 30 contained therein. Attached to the upper end of shaft member 21 is elongated shaft member 31 which proceeds through and is slidable within guiding block 32. Shaft member 31 is of a sufficient diameter that when abutting with surface 27 of block 22 a fluid tight seal is provided by means of O-ring 30. Threadably affixed upon shaft 31 is spring adjuster 33. Located between and abutting against spring adjuster 33 and guiding block 32 is power spring 34. The lower portion of shaft 31 has a series of graduated circumferential marks 35, the purpose of which will be later explained in the discussion of the operation of sampler 13. The upper end of sample collection chamber 28 is formed by surface 36 of upper block number 37. Passage 38 connects sample collection chamber 28 with sample valve assembly 39 and 40. In the preferred embodiment sample chamber 28 is capable of holding approximately a one gallon sample of borehole fluid. However, the size of sample chamber 28 is purely a matter of choice, within the constraints of borehole diameter and instrument length. The upper portion of housing 16 has sub 41 threadable connected thereto. Sub 41 is of a type suitable for attachment to cable 12 so that the sampler 13 can be raised or lowered within the borehole from a location on the earth's surface.

In the operation of the apparatus of FIGS. 1 and 2, in one embodiment a calculation is made of the pressure at the bottom of borehole 10. The sealing force exerted by power spring 34 upon the fluid tight O-ring seal 30 is adjusted by the threadable action of spring adjuster 33. Marks 35 located on shaft 31 provide a spring tension scale to allow accurate adjustment of the sealing force exerted by power spring 34. For bottom hole operation the sealing force exerted by spring 34 is adjusted to be slightly greater than the pressure at the bottom of the geothermal borehole.

Once the desired pressure setting is established, sampler 13 is placed into geothermal well 10. Annulus 18, passages 25 and 26 and elongated slot 23 are in communication with the fluid contents of well 10. Sampler 13 is lowered proximate the bottom of borehole 10. When landing pad 17 contacts the bottom of borehole 10 it is pushed up and into housing 16 by the weight of sampler 13 upon landing pad 17. Upward movement of landing pad 17 causes simultaneous upward movement of shafts 21 and 31. The upward movement of shaft 31 breaks O-ring seal 30 while upward movement of shaft 21 places sample chamber 28 to be in fluid communication with borehole 10 by way of ports 19 and 20, annulus 18, passages 25 and 26, and elongated slot 23. Sampler 13 is allowed to sit on the bottom of borehole 10 a sufficient time to allow sample chamber 28 to be filled with a liquid or steam sample. When sufficient time has elapsed for sample chamber 28 to be filled, sampler 13 is lifted by means of cable 13 of the bottom of borehole 10. As landing pad 17 is removed from contact with the bottom of borehole 10 the spring pressure exerted by power spring 34 to the largest extent and by spring 24 to a small extent cause downward movement of shafts 31 and 21 and pad 17 resulting in the establishment of a fluid tight seal by O-ring 30. The sealing force created by springs 34 and 24 is greater than that of the surrounding borehole 10 resulting in a positive seal allowing the borehole liquid or steam sample, principally representative of bottom of borehole 10, to be retrieved to the surface with little change in thermodymanic state.

When sampler 13 is withdrawn from the geothermal borehole 10, sub 41 is removed from housing 16. A portable sample chamber or pressure gauge (not shown) can be attached to valve outlet 40 and valve 39 opened allowing a pressure test or sample extraction to be performed on the contents of sample chamber 28. The retrieved samples are than available for chemical analysis, to aid in analysis of geothermal borehole conditions.

At times it is desirable to take intermediate samples within the borehole 10. In such a case the operation of sampler 13 is identical with the above described method with the exception of establishing of the spring sealing force. Instead of calculating the pressure at the lower extremity of the borehole 10 a calculation is made of the approximate pressure at the depth in the borehole 10 at which the sample is desired. The sealing spring force is then set as above by adjustment of spring adjuster 30 on shaft 31. When sampler 13 reaches a depth within the borehole 10 where the pressure exceeds the sealing force exerted by springs 24 and 34, O-ring seal 30 is broken placing sample chamber 28 into fluid communication with the borehole 10. When the pressure within sample chamber 28, combined with the pressures exerted by springs 24 and 34 equalize with the pressure at the sample depth within the borehole 10, O-ring seal 30 is reformed where upon sampler 13 can be removed from borehole 10. The retrieved sample is removed from sample chamber 28 as explained above.

Many modifications and variations besides those specifically mentioned may be made in the techniques and structures described herein and depicted in the accompanying drawings without departing substantially from the concept of the present invention. For example, instead of a dove-tailed groove with an O-ring sealing means it is possible to use alternate sealing means such as a soft metal sealing material combined with a knife edge seat or instead of measuring the pressure by means of an externally connected gauge a pressure measuring means could be made a permanent part of the sampler apparatus. Accordingly, it should be clearly understood that the forms of the invention described and illustrated herein are exemplary only, and are not intended as limitations on the scope of the present invention.

The embodiments of the invention in which an exclusive property or privilege is claimed are defined as follows:

1. An apparatus for collecting a sample of the fluid contents in a higher temperature borehole, at a predetermined location within said borehole, comprising:

an elongated body member adapted to traverse said borehole;

a sample retention chamber within said body member;

sealing means for isolating said chamber from said borehole contents; and adjustable means for establishing the sealing force of said sealing means, said sealing force being established so that said sealing force will be overcome at a predetermined location within said borehole, thereby placing said chamber in fluid communication with said borehole.

2. The sampler of claim 1, wherein said adjustable means will cause said sealing means to isolate said chamber from said borehole upon upward movement of said sampler from said predetermined location in said borehole.

3. The sampler apparatus of claim 1, wherein said sealing means comprises:

an O-ring seated in a groove within a fixed surface; and a moveable member with a flat sealing surface for contacting said O-ring thereby providing a fluid tight seal.

4. The sampler apparatus of claim 3, wherein said adjustable means for establishing said sealing force, comprises:

a spring member positioned within said chamber; and a spring retention member, threadable upon said moveable member for setting the sealing force exerted by said sealing surface upon said O-ring.

5. An apparatus for collecting a sample of the fluid contents in a high temperature borehole, at a location proximate the bottom of said borehole, comprising:

an elongated body member adapted to traverse said borehole;

a sample chamber formed within said body member;

sealing means isolating said chamber from said borehole;

a pad member slidably mounted in and extending from said body member for contacting the bottom of said borehole;

shaft means connected to said pad member for opening said sealing means when said pad member contacts the bottom of said borehole, thereby placing said chamber in fluid communication with said borehole; and means for causing said sealing means to be reformed when said pad member is removed from contacting said bottom of said borehole, thereby retaining a sample of the contents of said borehole, said sealing means comprising an O-ring seated in a groove formed in a non-moveable surface, and a parallel surface formed by a portion of said shaft means for contacting said O-ring thereby establishing a fluid tight seal.

6. The sampler apparatus of claim 5, wherein said means for reforming said seal comprises a spring member within said chamber.

* * * * *